United States Patent [19]

Jacober et al.

[11] Patent Number: 4,805,898

[45] Date of Patent: Feb. 21, 1989

[54] RECREATIONAL SLIDE SYSTEM AND COMPONENTS THEREOF

[76] Inventors: Jeffrey M. Jacober, 2 Round Hill Ct., East Greenwich, R.I. 02818; Antone F. Macedo, Jr., P.O. Box 33, Manville, R.I. 02838; Robert H. Bruno, 208 Burnham Rd., Avon, Conn. 06001

[21] Appl. No.: 96,780

[22] Filed: Sep. 15, 1987

[51] Int. Cl.[4] ..... A63G 21/00

[52] U.S. Cl. ..... 272/56.5 R; 4/506; 104/70; 272/1 B

[58] Field of Search ..... 272/56.5 R, 56.5 SS, 272/1 B, 32; 104/59, 69, 70, 72, 73; 182/48; 193/11, 25 A, 25 R, 25 E, 2 R; 4/487, 488, 494, 506, 526, 585

[56] References Cited

U.S. PATENT DOCUMENTS

| | | | |
|---|---|---|---|
| 952,315 | 3/1910 | Erwin et al. | 182/48 |
| 1,648,196 | 11/1927 | Rohmer | 104/70 |
| 1,699,065 | 2/1929 | Hilpert . | |
| 2,446,905 | 8/1948 | Buffum | 272/56.5 R |
| 2,616,096 | 11/1952 | Hasselquist | 4/506 |
| 2,705,144 | 3/1955 | Ridgway | 272/56.5 R |
| 2,839,762 | 6/1958 | Nomura | 4/506 X |
| 2,841,396 | 7/1958 | Foss | 272/56.5 R |
| 2,982,547 | 9/1960 | Carrier . | |
| 3,246,892 | 4/1966 | Grudoski . | |
| 3,276,176 | 10/1966 | Jonsson et al. . | |
| 3,715,120 | 2/1973 | Peltola . | |
| 3,942,198 | 3/1976 | Jewett . | |
| 4,109,904 | 8/1978 | Becker et al. . | |
| 4,145,042 | 3/1979 | Becker et al. . | |
| 4,198,043 | 4/1980 | Timbes et al. . | |
| 4,343,464 | 8/1982 | Dose . | |
| 4,529,660 | 7/1985 | Heim . | |

FOREIGN PATENT DOCUMENTS

| | | | |
|---|---|---|---|
| 2226128 | 12/1973 | Fed. Rep. of Germany | 4/506 |
| 1403504 | 8/1975 | United Kingdom | 182/48 |
| 2110944 | 6/1983 | United Kingdom . | |

*Primary Examiner*—David A. Scherbel
*Assistant Examiner*—Richard E. Chilcot, Jr.
*Attorney, Agent, or Firm*—Lockwood, Alex, Fitzgibbon & Cummings

[57] ABSTRACT

A recreational slide assembly is provided which includes one or more of an improved angularly upstanding slide provided with a web-like flexible slide, a buoyant landing pad or splash pad attached to the bottom of the web-like slide member and extending therefrom into a water-containing pool, the pool being preferably in the form of a soft-walled, non-inflatable assembly which is retained in its operative condition by reason of water contained therein, and a water distribution pipe constituting a load bearing member of the frame of the slide assembly. The preferred water distribution pipe holds the upper margin of the flexible slide member to assist in maintaining it in operative position, supports a platform member forming a part of the slide and supplies a spray of water along the flexible slide member to lubricate the same.

24 Claims, 3 Drawing Sheets

RECREATIONAL SLIDE SYSTEM AND COMPONENTS THEREOF

BACKGROUND OF THE INVENTION

The present invention is generally directed to a recreational water slide system and various components of the system. More particularly, the invention includes components which are readily assembled into a combination system that incorporates one or more of a web-like sliding surface, a landing pad positioned at the bottom end thereof, a multi-purpose water distribution member, and a soft-walled but non-inflated pool. Each such component assembly is readily disassembled for shipping or storage in a compact container or area.

Recreational water slides are undergoing increased popularity due, at least in part, to steadily increasing installation of backyard pools. Various forms of slides are sold as accessories with such pools, the most common form including an angularly upstanding slide providing a smooth and rigid sliding surface, joined at the top of the slide with an access ladder, the slide being positioned so that the discharge end intersects the side of a pool to discharge a person directly into the pool.

Slides have been used in conjunction with swimming pools or wading pools. A person leaving the slide for landing in a relatively large swimming pool may strike the water with a rather substantial force thereby creating a jolt as well as splashing water to a degree that can be frightening to the uninitiated person, particularly a young child. Additionally, if the pool is of swimming depth, a child sliding into it will rapidly sink, and unless such child is an experienced swimmer, regaining the surface of the water may be somewhat frightening.

By comparison, the normal children's wading pool, which is typically much shallower and smaller in area than is a typical swimming pool, is not particularly suitable for receiving a child from the discharge end of a slide if the child is traveling at any speed sufficient to create excitement and enjoyment from the use of the slide. The child hitting the water in a wading pool will tend to quickly hit the bottom of the pool, which is typically a solid, hard surface. Additionally, uncontrolled splashing could occur, and this may well discourage the uninitiated child from this use of the slide.

Another important consideration in dealing with water slides and attendant assemblies, such as covered by the present invention, involves ease of assembly and disassembly as well as convenience of storing. Many backyard aquatic systems are used in areas where changes in seasons require termination of use for long periods of time. While some systems are designed to remain exposed to winter elements or the like, such equipment is normally rather expensive due to its weather resistant properties. Certain of the equipment used currently is designed to be dismantled for storage. For water slides which are conventionally formed from metallic or other rigid materials, dismantling of them is somewhat restricted, and a relatively large storage area is required to handle these types of water slide systems.

The present invention is directed to new and improved components and combinations of components of a recreational water slide system, the components and combinations of such components overcoming the various disadvantages and restrictions of prior systems as set forth hereinabove. Included in the features of the present invention is a basic water slide formed from a frame system that may be readily assembled and disassembled and which includes a flexible slide member which may be readily assembled on and disassembled from the frame member. The flexible slide member is readily stored.

The slide structure preferably includes a water distribution assembly which performs multiple functions including that of supplying a spray of water to lubricate the surface of the flexible member of the slide. This water distribution assembly is arranged in the system to form a load-bearing part of the frame member of the slide while also supporting a platform member which the user utilizes for ultimate launching onto the flexible slide. This assembly further functions to vertically anchor the flexible slide.

Another feature of the new and improved system includes the use of a landing pad or splash pad which is preferably integrally formed with the flexible slide member and which projects outwardly beyond the discharge end of the slide to float on the surface of a pool of water and to receive a child or person using the slide in a safe and comfortable manner to provide a unique landing sensation that eliminates sudden uncontrolled sinking.

Still further, the present invention includes a new and improved soft-walled, non-inflatable pool which is constructed to be held in its upright operable condition by water received therein and yet be readily subject to folding or rolling for efficient storage purposes. This pool is of a soft character to further insulate the child or person utilizing it from discomfort or the threat of injury.

It is a general object of the present invention to provide a recreational water slide system and components thereof that are especially advantageous for backyard use.

Another object of this invention is to provide a recreation water slide system that effects controlled sinking of the user in a unique and pleasurable manner to avoid frightening or threatening sensations or splashes.

Still a further object of the present invention is to provide a water slide capable of use with pools of differing sizes, the slide including a landing pad or splash pad which checks the momentum of the person using the slide sufficiently to provide controlled splashing and to avoid rapid sinking.

Another object of the present invention is to provide a recreational water slide system including components which are readily assembled and disassembled and/or reduced in size by rolling, folding or the like for efficient storage thereof.

Other objects and advantages of the invention will become apparent from the following description of a preferred embodiment of the system and of the components thereof.

SUMMARY OF THE INVENTION

A recreational water slide system and components thereof are provided which include a water slide of readily assembled and disassembled frame members carrying a flexible slide member, the slide member including along the bottom margin thereof a landing pad or splash pad of special design which due to its buoyant nature will float on a surface of water, be slowly submerged within the water when a user slidingly lands thereon, and upon released will automatically return to the surface of the water due to its inherent buoyancy. Another component of the system is a specially designed pool of partially rigid but basically flexible material which when filled with water will retain its water retention capabilities and yet when emptied may be rolled or folded for convenient storage. The frame member of the slide preferably further includes a multifunction water distribution member which additionally acts as a load bearing member in the frame, functions as an anchor for the top portion of the flexible slide member, and supports a platform located at the juncture of the ladder portion and the top portion of the slide.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numeral identify like elements, and in which:

DESCRIPTION OF THE PREFERRED EMBODIMENTS

Figures 1, 3:
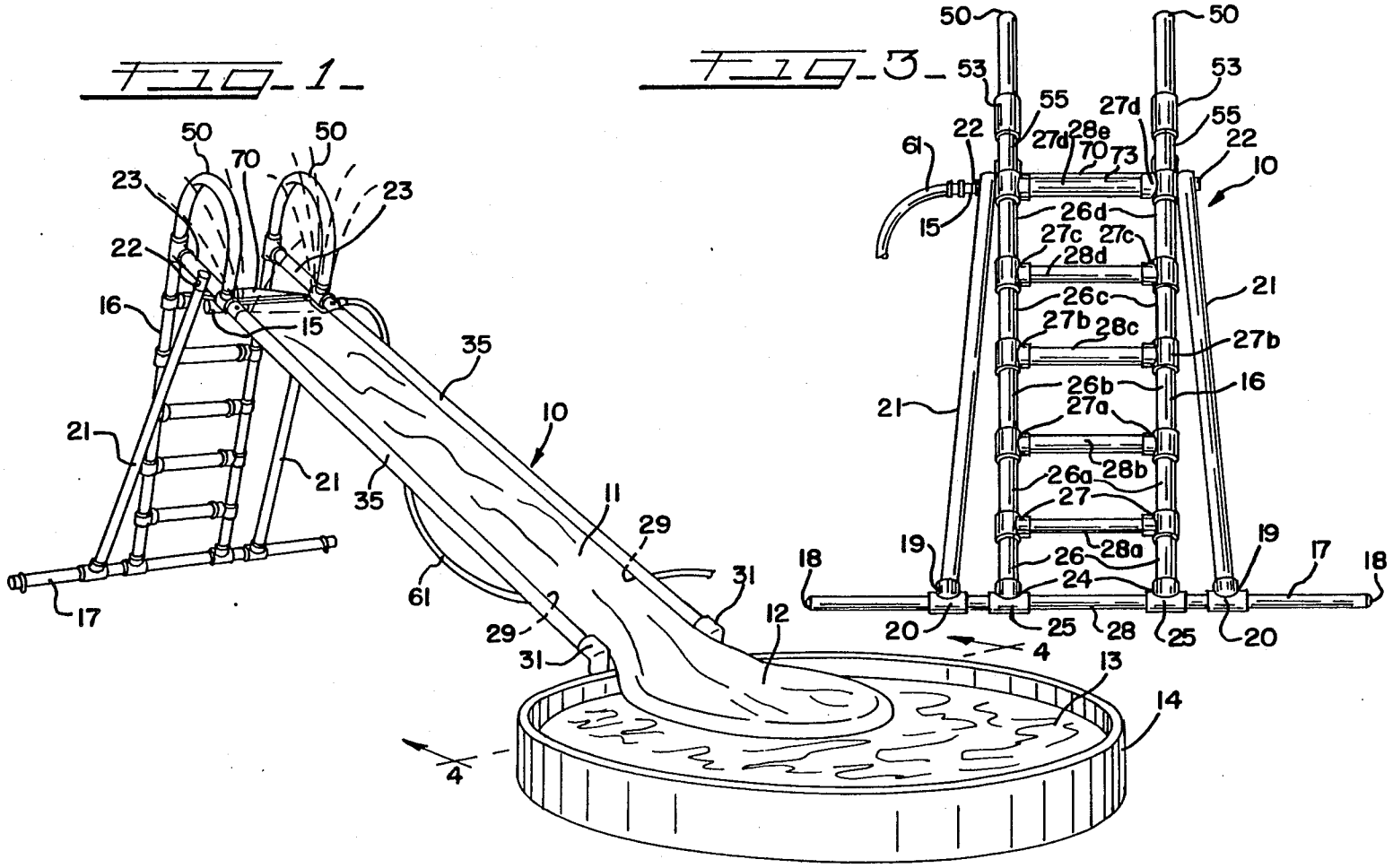
FIG. 1 is a perspective view of the combination recreational water slide system and components thereof constituting the present invention.
FIG. 3 is an end elevational view of the slide component of the system as viewed from the ladder end thereof.
Figures 2, 4, 5, 6:
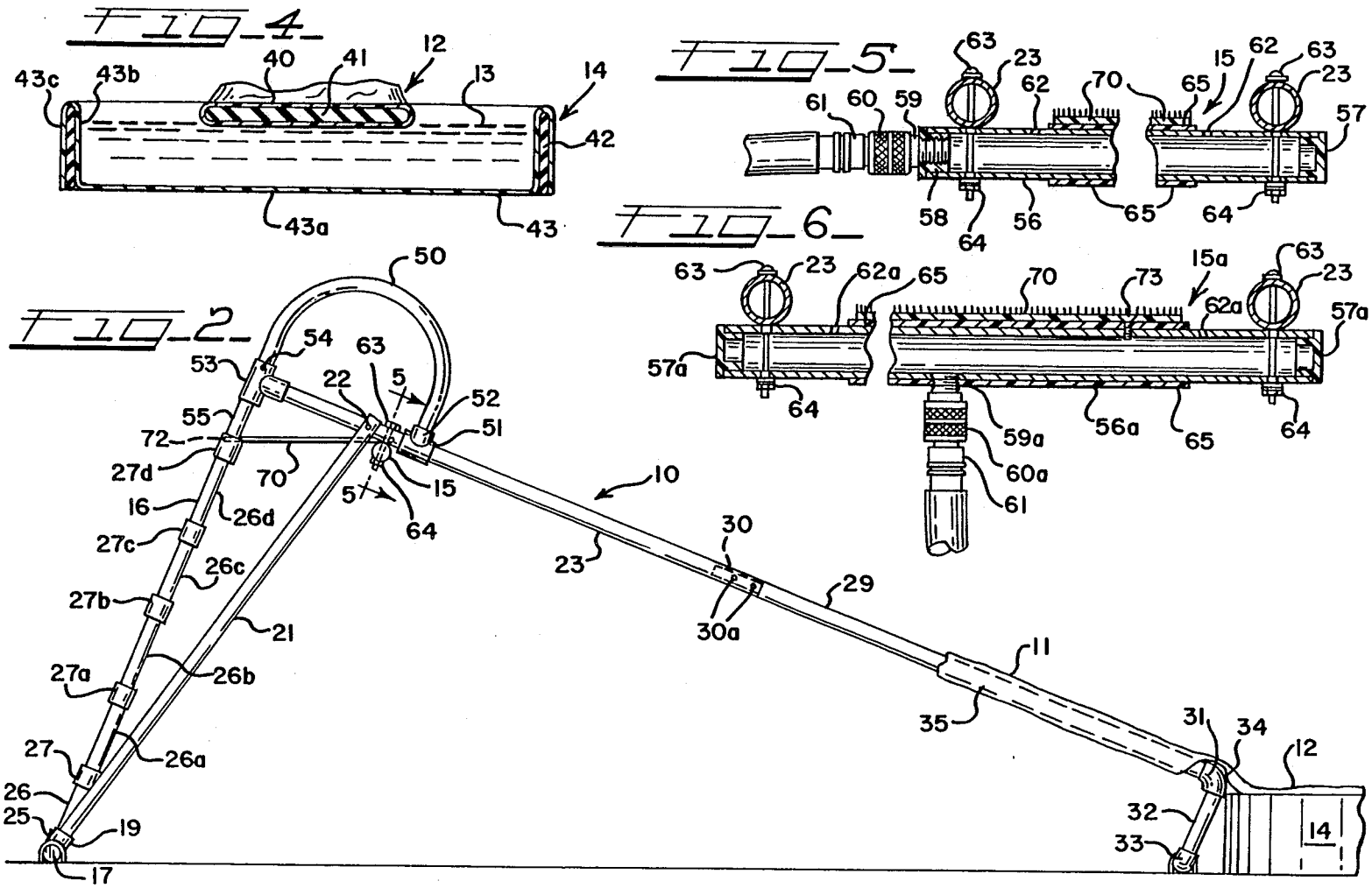
FIG. 2 is a partly fragmented side elevational view of the water slide system illustrated in FIG. 1.
FIG. 4 is a cross-sectional view of the pool and landing pad shown in FIG. 1, taken along line 4—4 of FIG. 1.
FIG. 5 is an enlarged, partly fragmented sectional view of the water distribution means of the slide system shown in FIG. 1, taken along line 5—5 of FIG. 2.
FIG. 6 is a view similar to FIG. 5 illustrating a modified form of water distribution means.

Referring in particular to FIGS. 1 through 3, the combined recreational water slide system of the present invention includes a basic water slide assembly 10 including a flexible slide member 11. The combined system further can incorporate a tongue-like landing pad or splash pad 12 which floats generally on the surface of a body of water 13 (FIG. 1). Pad 12 is preferably an extension from the lower margin of the flexible slide member 11. Typically, the body of water 13 is contained within a pool 14 positioned at the base of the slide assembly 10. The system further can include a multipurpose water distribution means in the form of pipe-like chamber 15 which extends transversely of the slide assembly 10 adjacent the apex thereof.

The slide assembly 10 is formed from a frame member including a sloped slide area on which is mounted the flexible slide member 11 and a ladder assembly 16. Referring first to the ladder assembly 16, FIG. 3 illustrates the provision of a transversely extending tube or pipe 17 which is ground engaging and is of sufficient length to provide lateral stability to the slide assembly 10. Further stability can be imparted by U-shaped stakes as shown. Tube 17 may be closed at its ends by suitable caps 18 and inboard of each cap a Tee 19 or the like of known configuration telescopically receives tube 17 therethrough and typically is fixed to the tube by screws 20 or the like. Each Tee 19 has received therein an upwardly projecting ladder and slide member stabilizing tube or pipe 21 which at its upper end is connected by screws 22 or the like to a pair of laterally spaced tubes 23 which extend downwardly in angular relation from the ladder 16 to define the sloped slide area of slide assembly 10 as will be described. Tubes 21 preferably are slightly inclined inwardly toward one another in an upward direction in order to establish a wider ground engaging space therebetween to thereby assist in providing stability to the slide assembly 10 in conjunction with the base supporting tube 17.

Ladder assembly 16 is attached to base tube 17 through Tees 24 or the like positioned inboard of Tees 19 and fixed to base tube 17 by screws 25 or the like. Tees 24 receive upwardly projecting tube sections 26, the upper ends of which are received in Tees 27 or the like. Tube sections **26*a*, similar to tube sections 26, are received in the upper ends of Tees 27 and, in turn, are received in the bottom ends of Tees 27*a*. This structural arrangement is repeated in the manner described to utilize short tube sections 26*b*–26*d*, these tube sections being suitably connected with similar Tees 27*b*–27*d*. The center portion of base tube 17 located between Tees 24 constitute the first step or rung ladder 16. Short tube sections extend between paired Tees 27–27*d* to establish a series of successive steps or rungs 28 through 28*e*. Ladder assembly 16 may be preformed into a single component if desired, such as by cementing tube sections 26 through 26*d* and 28*a* through 28*e* in the respective Tees. Otherwise, if it is desired to permit ladder 16 to be completely disassembled, suitable screws may be utilized to fix the various tube sections in the Tees. Also, the tube sections 26 through 26*d* can be a single-piece tube onto which the rungs 28 through 28*e*** are secured.

Referring in particular to FIG. 2, the laterally spaced tubes 23 defining the sloped slide area can be removably attached to an additional pair of laterally spaced tubes 29 which are swaged at the upper ends thereof to include insert portions 30 telescopically received in adjacent ends of tubes 23 an held in place by a pair of screws **30*a* or the like. The lower ends of the laterally spaced tubes are received in or otherwise secured to elbows 31 which are directed downwardly, such as at a right angle, to receive a pair of laterally spaced tube sections 32, the lower ends of which receive elbows which, in turn, receive a transversely extending tube section (not shown) of approximately the same length as center portion 28 of support tube 17. If a longer transversely extending tube section is desired, such may be accommodated by replacing the elbows 33 with Tees or the like. Here again, the various tube sections 29 and 32 may be cemented into elbows 31 and 33 or screws 34** or the like may be utilized to secure the connections.

Flexible slide member 11 is in the form of a web of fabric or sheeting provided along opposite margins with tube-like openings in the form of pockets 35 which receive the laterally spaced tubes 23, 29. Preferably, elbows 31 at the base of the slide are detachable from tube sections 29 to permit easy assembly and disassembly of flexible slide member 11 to and from the slide assembly 10. In this manner tube sections 29 may be inserted in pockets 35 and flexible slide member 11 moved upwardly to also receive tube sections 23 and ultimately into operative position as best shown in FIG. 1. Thereafter, the bottom ends of tube sections 29 are inserted in elbows 31, and screws 34 or the like complete the assembly. Disassembly is accomplished by reversing the procedure described.

The bottom margin of flexible slide member 11 that is shown has the landing pad or splash pad 12 formed therewith, as best shown in FIGS. 1 and 2. Landing pad 12 is of tongue-like construction, preferably having an outer component constituting an integral extension of the flexible slide member 11. As seen in FIG. 4, the pad 12 includes an outer component which is a cover 40 that is in the form of an envelope of flexible waterproof material. Suitable buoyant material 41 fills the interior of the envelope 40 and is sealed within the envelope. Buoyant member 41 may be formed from a closed cell buoyant foam or the like, such as ethylenepropylene foam or closed cell eva foam. The object here is that the landing pad must be sufficiently buoyant to float on the water 13 and, upon immersion and then release, to again automatically regain its floating position on the water surface. Buoyant member 41 may be substantially circular and may have peripheral edge portions that are raised or thicker than the central portion of the buoyant member 41. Under appropriate conditions, this central portion could retain water while the raised edge portions do not.

Flexible slide member 11 may be formed from any suitable sheeting to provide a tarpaulin-like structure between the parallel bars 23. The envelope 40 of landing pad 12 can also be made of such material. It has been found that a suitable material in this regard is nylon reinforced polyvinyl chloride (PVC) sheeting. Elongated pockets 35 are formed in any suitable manner such as by folding over opposite edges of the material used and stitching or heat sealing margins of the material to the body portion of the material to create the elongated pockets or tube-like collars. Preferably, flexible slide member 11 will be stretched somewhat in a lateral direction to form a flexible web between supporting elongated bars such as those formed from the tube sections 23 and 29.

The pool assembly 14 is of a soft-walled, non-inflatable construction. Essentially, the pool includes an upstanding, circumferentially continuous soft-wall member 42 that is substantially enclosed by a flexible cover member 43 which also defines the bottom of pool 14 as shown in FIG. 4. Flexible cover member 43 includes the transversely extending main bottom section **43*a* which along the outer margin thereof is formed with an upwardly extending section 43*b* overlying the inner surface of wall member 42 and looping over the top surface of wall member 42 to define an outwardly and downwardly extending section 43*c* terminating adjacent the outer bottom edge of wall member 42. Cover member 43 in cross-sectional configuration and in the erected condition of the pool assembly is generally U-shaped, including the flat transverse bottom portion 43*a* connected to a first upstanding cover portion 43*b* positioned along the inner surface area of wall member 42 and overlapping the top surface of wall member 42 while joining a second, downwardly extending cover portion 43*c* positioned along the outer surface area of wall member 42**.

By reason of the foregoing construction, pool assembly 14 will to a substantial extent retain its shape with wall member 42 being upstanding. This wall member may be formed from semi-rigid foam material, such as ethylenepropylene. Flexible cover member 43 may be formed from vinyl sheeting or the like. During use, the presence of water 13 assists in maintaining the upright and functional condition of the pool. Water will be adequately retained in the pool even when wall member 42 is jarred. However, the pool assembly is not so rigid as to cause any harm to any person striking the same during utilization of the pool, such as when engaging a side of the pool after entering same via a slide such as the slide assembly 10. Under such use conditions, the pool wall can generally fold over, and excess water can then escape the pool assembly as needed. Additionally, it is readily folded and rolled up for storage purposes.

Referring again to FIGS. 1 through 3, the apex of slide assembly 10 defining the juncture of the ladder assembly 16 and the flexible slide member 11 is defined by a pair of laterally spaced hand rails 50. These rails are provided with a radius with one end of each received in a Tee 51 or the like mounted on tube sections 23 with the rail secured in place by screw 52 or the like; the other end of each rail 50 is received in a portion of Tees 53 or the like secured by screws 54 or the like, Tees 53 being mounted on tube sections 55 extending upwardly from Tees **27*d***.

The various tube sections described in connection with the frame of the water slide 10 may be formed from any suitable materials. For example, where the greatest requirement of structural strength exists, steel tubes may be used. Otherwise, depending upon the size of the slide and the weight of the average person using the same, PVC tubing may be utilized. While hollow tubing is especially advantageous because of its light weight and ready availability, solid tubing could be used as desired. Also, cross-sectional configurations other than the circular ones shown in the drawings can be used.

Figure 7:
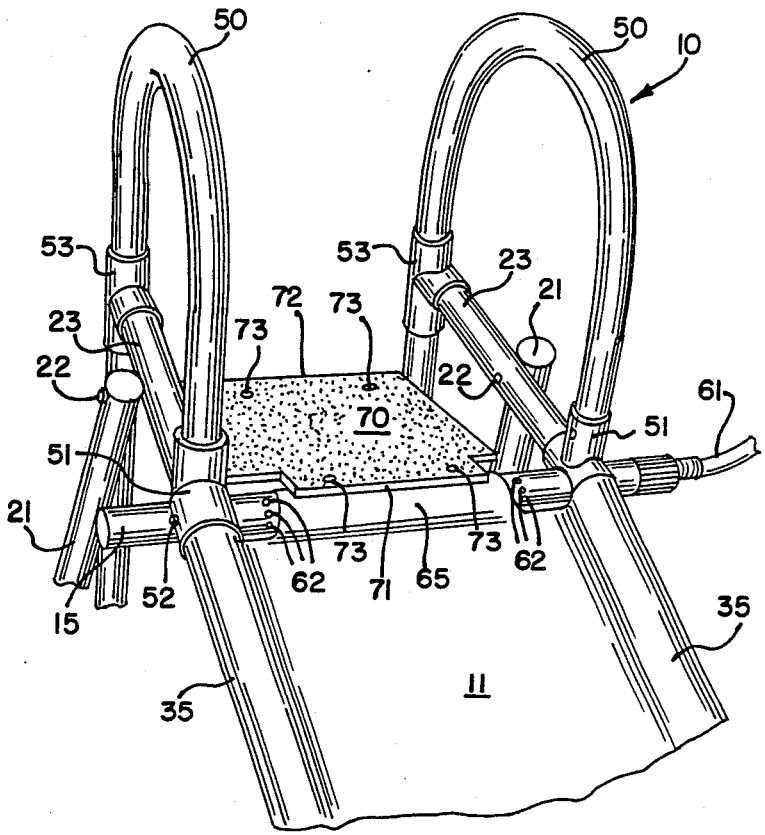
FIG. 7 is an enlarged fragmentary perspective view of the top portion of the slide component at the juncture of the ladder and slide members.

As previously described, water distribution means 15 in the form of a tube or pipe extends transversely of tube sections 23 adjacent their juncture with the ladder assembly 16. FIGS. 5 and 6 illustrate different forms of water distribution means 15 and **15*a*, respectively. Referring to FIG. 5, water distribution means 15 includes a tube or pipe section 56 which is sealed at one end by a suitable cap 57. Cap 57 is secured by cementing and/or threading or the like and provides a waterproof seal. The opposite end of tube 56 has fixed therein an internally threaded bushing 58 which receives the threaded end of a connector 59 having an end 60 which in turn receives the end of a hose 61. In this manner water is supplied to the interior chamber of tube 56 and adjacent its opposite ends. Such tube is provided with at least a pair of spray openings 62 which permit the spraying of water in the direction of the broken lines shown in FIG. 1 when the interior chamber of tube 56 receives water under pressure from hose 61 or the like. Three pairs of these spray openings are illustrated in FIG. 7**.

Referring again to FIG. 5, tube 56 is mounted below slide tube sections 23 in engagement with the bottom surfaces thereof so as to transversely span the space between tube sections 23. Spray openings 62 are located inwardly of tube sections 23 so that the latter do not interfere with the spraying of water for the purpose to be described. Tube 56 is attached to tube sections 23 by bolts 63 or the like received therethrough and secured by nuts 64.

Water distribution means 15 preferably also functions as a load-bearing member of the frame of the slide assembly 10. This permits a reduction in the cost of manufacture of the slide by eliminating a separate structural member. As best seen in FIGS. 5 and 7, the top margin of the flexible slide member 11 is provided with an integrally formed anchor portion 65 which is folded back on itself in the manner of the elongated pockets 35. This anchor portion 35 is received around water distribution means 15 to thus secure the slide member 11 to the water distribution means 15 and prevent downward movement of the slide member 11. Anchor portion 65 may be permanently or temporarily formed in the shape of a collar or pocket. If it is permanently thus formed, assembly is accomplished by slidably inserting the water distribution means 15 through the collar 65 and then attach it to the tube sections 23. Otherwise, suitable releasable fastener means (not shown) may be utilized to attach the anchor portion or collar 65 to the water distribution means 15.

By reason of the foregoing arrangement, water distribution means 15 performs a further function of anchoring the top portion of flexible slide member 11 in operative position on the slide assembly 10. This is an important function inasmuch as sufficient rigidity must be supplied to the web-like flexible slide member 11 in order to maintain its stretcher-type smoothness during use. As shown in FIG. 1, water distribution means 15 supplies sprays of water onto the flexible slide member 11 to lubricate the same, the water ultimately being collected in pool 14 or the like.

Water distribution means 15 performs still another function. Referring in particular to FIG. 7, the juncture of the ladder assembly 16 and the flexible slide member 11 is bridged by a flat platform member 70 having a front edge portion 71 that is supported on the water distribution means 15. Platform member 70 also has a rear edge portion 72 (FIGS. 2 and 3) supported on ladder rung **28*e*. Platform member 70 may be formed from any suitable rigid material and preferably will be provided with a non-skid surface consisting of some suitable fabric or the like. The platform member 70 may be suitably attached such as with fasteners 73 to the respective top surface areas of the water distribution means 15 and of the ladder rung 28*e*. Fasteners 73 are readily removable to permit disassembly of the platform member 70** and related parts.

Platform member 70 spans the space between the top ladder rung **28*e* and the flexible slide member 11. The user of the slide assembly 10 climbs the ladder assembly 16 to reach the platform member 70, utilizing hand rails 50 for stability. The user then either sits down on platform 70 to ease onto the slide member 11 or launches himself or herself onto slide member 11 by lifting his or her body and pitching forwardly using the hand rails 50**.

FIG. 6 illustrates a modified form of water distribution means **15*a* wherein a distributing tube 56*a* is provided with a pair of cemented or otherwise secured sealing end caps 57*a* and a hose connection intermediate of such ends. The hose connection is preferably accomplished generally centrally of tube 56*a* by receipt of one end 59*a* of a coupler in engagement with threads extending through a wall portion of the tube 56*a*, the other end 60*a* of the coupler receiving the connecting end 61*a* of a suitable hose to supply water to the interior chamber of the tube 56*a*. Spray openings 62*a* are provided in the manner previously described, and this modified water distribution means 15*a* is attached to tube sections 23 of the slide assembly 10 in the same manner previously described. FIGS. 5 and 6 illustrate the manner in which the anchor portion or collar 65 is received about water distribution means 15, 15*a* and the platform 70** is supported thereon.

The recreational water slide system described is uniquely effective in encouraging use by small children. The flexible slide member is effectively lubricated to avoid sliding burns, the landing pad cushions any shock while restricting splashing and dunking of the child under water, and the soft, flexible nature of the pool prevents injury to the child. All of this is accomplished in an inexpensive and effective manner. The system is readily assembled or disassembled and is designed with storage efficiency in mind. The water distribution means performs multiple functions, namely, load-bearing capabilities in the structure of the slide, anchoring of the top portion of the flexible slide member, support of the bridging platform member and supply of water spray to lubricate the flexible slide member. The structure of the flexible slide member permits economical manufacture especially inasmuch as the retention tongue and landing pad can be readily integrally formed. This type of cost saving approach is further illustrated in the uncomplicated yet advantageous construction of the pool. Thus, many advantages are derived from the water slide system of the present invention.

While particular embodiments of the invention have been shown and described, it will be appreciated by those skilled in the art that changes and modifications may be made thereto without departing from the invention in its broader aspects, and, therefore, the aim in the appended claims is to cover all such changes and modifications as fall within the true spirit and scope of the invention.

We claim:

1. A recreational slide comprising:

a ladder assembly having a ground-engaging end and an upwardly extending opposite end;

a frame assembly having one end secured to said upwardly extending opposite end of the ladder assembly, said frame assembly further including a ground-engaging other end and a pair of spaced and substantially parallel support members which define a sloped slide area generally between said one end and said other end of the frame assembly;

a web-like flexible slide member attached to both of said support members along opposite margins of said web-like flexible slide member and substantially filling the space between said support members to provide a sloped flexible sliding surface extending between first and second end portions of said web-like flexible slide member, said first end portion being at a height greater than said second end portion, said web-like flexible slide member includes anchor means along said first end portion thereof, said anchor means being attached to said frame assembly for holding said slide member in extended condition along said sloped slide area; and water distribution means form a part of said frame assembly generally adjacent to said first end portion of said flexible slide member, said anchor means being attached to said water distribution means to hold said flexible slide member in extended condition along said sloped slide area.

2. The recreational slide of claim 1, wherein said opposite margins of said web-like flexible slide member define tube-like elongated pockets which are slidingly received on said pair of substantially parallel support members.

3. The recreational slide of claim 1, wherein said second end portion of said web-like flexible slide member includes a landing pad having buoyant means for having said landing pad float in a pool of water generally adjacent to said other end of the frame assembly.

4. The recreational slide of claim 3, wherein said landing pad includes a cover in the form of an envelope, said cover being formed of flexible waterproof material, and said landing pad further includes buoyant material received and sealed within said envelope, whereby said landing pad will float on the surface of a pool of water and upon release thereof after immersion in said pool will automatically return substantially to said surface to re-establish the floating condition of said landing pad.

5. The recreational slide of claim 1, wherein:

said water distribution means is in the form of a load-bearing member and includes interior chamber means for receiving water from a pressurized water source means;

water spray openings formed in said water distribution means in communication with said chamber means; and pressurized water source means connected to said water distribution means and in communication with said chamber means, whereby water sprayed from said water distribution means contacts said web-like flexible slide member to lubricate the sliding surface thereof.

6. The recreational slide of claim 5, wherein said anchor means is in the form of a collar channel formed along said first end portion of said flexible slide member and is received about said water distribution means intermediate said water spray openings.

7. A recreational slide comprising:

a ladder assembly having a ground-engaging end and an upwardly extending opposite end;

a frame assembly having one end secured to said upwardly extending opposite end of the ladder assembly, said frame assembly further including a ground-engaging other end and a pair of spaced and substantially parallel support members which define a sloped slide area generally between said one end and said other end of the frame assembly;

web-like flexible slide member attached to both of said support members along opposite margins of said web-like flexible slide member and substantially filling the space between said support members to provide a sloped flexible sliding surface extending between first and second end portions of said web-like flexible slide member, said first end portion being at a height greater than said second end portion;

said second end portion of said web-like flexible slide member includes a landing pad having buoyant means for having said landing pad float in a pool of water generally adjacent to said other end of the frame assembly;

said landing pad includes a cover in the form of an envelope, said cover being formed of flexible waterproof material, and said landing pad further includes buoyant material received and sealed within said envelope, whereby said landing pad will float on the surface of a pool of water and upon release thereof after immersion in said pool will automatically return substantially to said surface to re-establish the floating condition of said landing pad; and water distribution means form a part of said frame assembly generally adjacent to said first end portion of said flexible slide member, and wherein said flexible slide member includes anchor means attached to said water distribution means for holding said flexible slide member in extended condition along said sloped slide area.

8. The recreational slide of claim 7, wherein:

said water distribution means is in the form of a load-bearing member and includes interior chamber means for receiving water from a pressurized water source means;

water spray openings formed in said water distribution means in communication with said chamber means; and pressurized water source means connected to said water distribution means and in communication with said chamber means, whereby water sprayed from said water distribution means contacts said web-like flexible slide member to lubricate the sliding surface thereof.

9. The recreational slide of claim 8, wherein said anchor means is in the form of a collar channel formed along said first end portion of said flexible slide member and is received about said water distribution means intermediate said water spray openings.

10. A landing pad for use with a recreational slide and a pool of water or the like that is generally adjacent to a discharge end of a sloping, sliding surface of the recreational slide, said landing pad comprising:

a cover in the form of an envelope, said cover extending from a flexible web of the sloping, sliding surface of the recreational slide and being formed from flexible waterproof material, and said cover is secured to the discharge end of the sloping, sliding surface of the recreational slide; and buoyant material received and sealed within said cover, whereby said landing pad will float on the surface of a pool of water and upon release thereof after immersion in said pool will automatically return substantially to said surface to re-establish a floating condition of said landing pad.

11. The landing pad of claim 10, wherein said landing pad is of a tongue-like configuration.

12. The landing pad of claim 10, wherein said buoyant material is a resinous material having a specific gravity less than that of water.

13. A water slide for use with a pool of water or the like, said slide comprising:

a main frame assembly including an angularly upstanding slide portion, ladder means connected to a top area of said slide portion, and ground-engaging vertical and lateral support means;

water distribution means forming a part of said main frame assembly adjacent the top area of said slide portion;

said water distribution means being in the form of a load-bearing member functioning as a part of said main frame assembly and including an interior chamber for receiving water from a pressurized water source means;

water spray openings formed in said water distribution means in communication with said interior chamber;

means for connecting said water distribution means to a pressurized water source means, whereby water sprayed from said water distribution means contacts said slide portion to lubricate the sliding surface thereof;

said slide portion includes a web-like flexible slide member supported by said frame assembly along opposite margins of said web-like flexible slide member; and said slide portion further includes anchor means along the top portion of said slide member and attached to said water distribution means to hold said web-like flexible slide member in an extended condition.

14. The water slide of claim 13, wherein said ladder means includes a series of vertically spaced transverse steps terminating in a top step spaced from but adjacent to said water distribution means; and platform means bridging the pace between said top step and said water distribution means and supported thereon along opposite marginal areas of said platform means.

15. The water slide of claim 13, wherein said anchor means is in the form of a collar channel formed along the top portion of said slide member and is received about said water distribution means intermediate said water spray openings.

16. A soft-walled, non-inflatable pool adapted to retain water for recreational use and to be readily storable when not in use, said pool comprising:

an upstanding circumferentially extending soft-walled member formed from semi-rigid material, said soft-walled member being upstanding without requiring inflation by a fluid;

a flexible cover member at least substantially enclosing said soft-walled member to prevent water from contacting the same, said flexible cover member further defining a flexible bottom for said pool bounded by said upstanding circumferentially extending soft-walled member; and said cover member in cross-sectional configuration of said pool and in the erected condition thereof is generally U-shaped and has a generally flat transverse bottom portion connected to a first upstanding cover portion positioned along the inner surface area of said wall member, overlapping the top surface of said wall member and joining a second downwardly extending cover portion positioned along the outer surface area of said soft-walled member.

17. The soft-walled, non-inflatable pool of claim 16, wherein said soft-walled member is formed from a thermoplastic foam material, and wherein said cover member is formed from polymeric sheeting material.

18. In combination, a water slide and water pool, said combination comprising:

a main frame assembly including a sloped slide portion joined at the top thereof with an upstanding ladder assembly;

a web-like flexible slide member attached to said sloped slide portion of said main frame assembly to define a tarpaulin-like flexible sliding surface, said flexible slide member includes anchor means along a top margin thereof for attaching said flexible slide member to said main frame assembly;

said main frame assembly includes a water distribution means for distributing water onto said flexible slide member;

a buoyant pad extending from a bottom margin of said slide member and projecting in a generally horizontal orientation from said main frame assembly; and pool means positioned outwardly of the bottom margin of said flexible slide member, said pool means being for containing water and for receiving said buoyant landing pad therein.

19. The combination of claim 18, wherein said buoyant landing pad is of tongue-like configuration and is formed from a resinous material.

20. The combination of claim 18, wherein said pool includes: an upstanding circumferentially extending soft-walled member formed from semi-rigid material; and a flexible cover member at least substantially enclosing said soft-walled member to prevent water from contacting the same, said cover member further defining a flexible bottom for said pool.

21. The combination of claim 18, wherein said water distribution means is at a juncture of said sloped slide portion and said ladder assembly;

said anchor means is attached to said water distribution means; and generally horizontal platform means is located between said ladder means and said water distribution means.

22. The combination of claim 21, wherein said pool includes: an upstanding circumferentially extending soft-walled member formed from semi-rigid material; and a flexible cover member at least substantially enclosing said soft-walled member to prevent water from contacting the same, said cover member further defining a flexible bottom for said pool.

23. The combination of claim 21, wherein said landing pad is of tongue-like configuration and is formed from a resinous material.

24. The combination of claim 23, wherein said pool includes: an upstanding circumferentially extending soft-walled member formed from semi-rigid material; and a flexible cover member at least substantially enclosing said soft-walled member to prevent water from contacting the same, said cover member further defining a flexible bottom for said pool.

* * * * *

UNITED STATES PATENT AND TRADEMARK OFFICE

CERTIFICATE OF CORRECTION

PATENT NO. : 4,805,898

DATED : February 21, 1989

INVENTOR(S) : Jacober et al.

It is certified that error appears in the above-identified patent and that said Letters Patent is hereby corrected as shown below:

On the title page, Item [21], "Appln. No.: 96,780" should read --Appln. No.: 96,670--.

Signed and Sealed this

Thirteenth Day of March, 1990

*Attest:*

*Attesting Officer*

JEFFREY M. SAMUELS

*Acting Commissioner of Patents and Trademarks*